US005101517A

United States Patent [19]

Douglas

[11] Patent Number: 5,101,517

[45] Date of Patent: Apr. 7, 1992

[54] SPORTS HELMET WITH TRANSPARENT WINDOWS IN THE SIDE WALLS

[76] Inventor: Willie Douglas, 519 Pulliam, San Angelo, Tex. 76903

[21] Appl. No.: 549,110

[22] Filed: Jul. 6, 1990

[51] Int. Cl.[5] ..... A42B 1/08

[52] U.S. Cl. ..... 2/424; 2/425

[58] Field of Search ..... 2/9, 410, 411, 414, 2/422, 423, 424, 425

[56] References Cited

U.S. PATENT DOCUMENTS

| | | | |
|---|---|---|---|
| 1,104,808 | 7/1914 | Kockrow | 2/411 |
| 3,153,242 | 10/1964 | Nedwick | 2/411 |
| 3,500,475 | 3/1970 | Otsuka | 2/425 |
| 3,577,562 | 5/1971 | Holt | 2/414 |
| 3,673,609 | 7/1972 | DeSimone | 2/414 |
| 3,707,004 | 12/1972 | Kapitan et al. | 2/424 |
| 3,751,728 | 8/1973 | Thompkins | 2/425 |
| 3,778,844 | 12/1973 | Hori et al. | 2/423 |
| 3,815,152 | 6/1974 | Bednarczuk et al. | 2/9 |
| 4,598,430 | 7/1986 | Nava | 2/424 |

FOREIGN PATENT DOCUMENTS

| | | | |
|---|---|---|---|
| 540145 | 4/1957 | Canada | 2/411 |
| 522770 | 6/1940 | United Kingdom | 2/414 |
| 945412 | 12/1963 | United Kingdom | 2/414 |

*Primary Examiner*—Werner H. Schroeder
*Assistant Examiner*—Michael A. Neas
*Attorney, Agent, or Firm*—Arthur F. Zobal; Geoffrey A. Mantooth

[57] ABSTRACT

The helmet of the present invention has a hard outer shell, a flexible and resilient inner shell and a face mask coupled to the outer shell. The side walls of the outer shell have transparent windows therein, which are located so as to be laterally of and rearwardly of the eyes of the wearer. The windows increase the peripheral vision of the wearer. The inner shell, which is removably coupled to the inside of the outer shell, is made up of foam with numerous springs embedded therein. The inner shell, with the springs and foam, absorb shock delivered to the helmet. Hearing protection to the wearer is also provided with narrow slots in the outer shell near the ears and with the inner shell completely surrounding each ear so as to attenuate any sound not entering through the slots.

22 Claims, 4 Drawing Sheets

SPORTS HELMET WITH TRANSPARENT WINDOWS IN THE SIDE WALLS

FIELD OF THE INVENTION

The present invention relates to helmets that are used by humans in sporting events such as football.

BACKGROUND OF THE INVENTION

The use of protective headgear is becoming a requisite in more and more sporting activities. The types of protective headgear range from the partial protection of a cycling helmet to the full protection afforded by a football helmet.

One problem with conventional football helmets is that the peripheral field of vision of the wearer is reduced. This is because a conventional football helmet has side walls that are positioned along the side of the face of the wearer. The front edge of each side wall is located laterally of the respective eye in order to provide protection to the side of the head, wherein the respective side walls limit peripheral vision.

Even though football helmets afford full protection to the head of the wearer, there is room for improvement to increase the safety to the wearer and the versatility of use. One such improvement would be to enhance the shock absorptiveness of the helmet. Conventional helmets have an inner shell that is made of foam, which serves to cushion the head against blows to the helmet. The foam, however, has limited shock absorptiveness. Another such improvement would be to decrease the weight of the helmet. Conventional football helmets are made out of polycarbonate (LEXAN) plastic, and as such, are relatively heavy. A lighter helmet would reduce the risk of injury, particularly to the neck of a wearer.

In addition to protection from impacts and shocks, a helmet should provide some type of hearing protection. Conventional helmets have large circular openings located near the ears, to enable the wearer to hear with the helmet on. The inner shell has a notch cut in its lower edge on each side for each ear. Thus, sound enters the ear through the circular side opening and through the underside of the helmet. During a game, players on the football field in a noisy stadium are exposed to high levels of noise. A helmet that would provide hearing protection would reduce the risk of hearing loss to the wearer.

SUMMARY OF THE INVENTION

It is an object of the present invention to provide a helmet that affords protection to the entire head of a wearer, while increasing the peripheral vision of the wearer.

It is a further object of the present invention to provide a helmet that can be used in sports, which helmet is lighter in weight than conventional helmets and is more shock absorbant than conventional helmets.

It is a further object of the present invention to provide a helmet that provides hearing protection to the wearer.

It is a further object of the present invention to provide a helmet that is versatile in its use in that it allows the interchangeability of face masks and padded inserts.

DESCRIPTION OF PREFERRED EMBODIMENT

The helmet 11 of the present invention, in accordance with a preferred embodiment, is shown in FIGS. 1–5. The helmet 11 enhances the peripheral vision of the wearer and the protection afforded to the wearer over prior art helmets. The helmet is also versatile in that it can be adapted to the needs of the individual wearer. The helmet 11 includes an outer shell 13, an inner shell 15 and a face mask 17.

Figure 2:
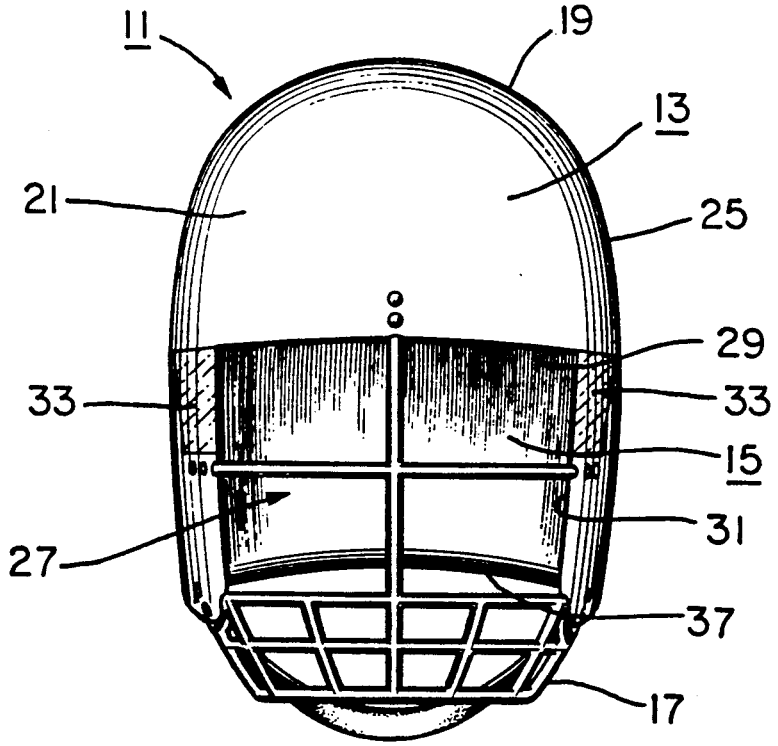
FIG. 2 is a front elevational view of the helmet.
Figure 3:
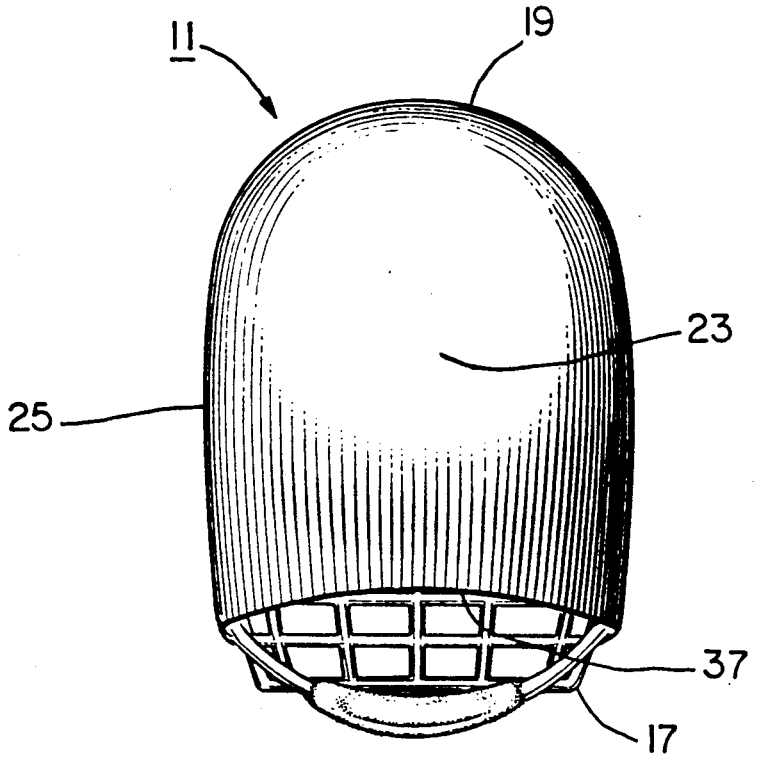
FIG. 3 is a rear elevational view of the helmet.
Figure 4:
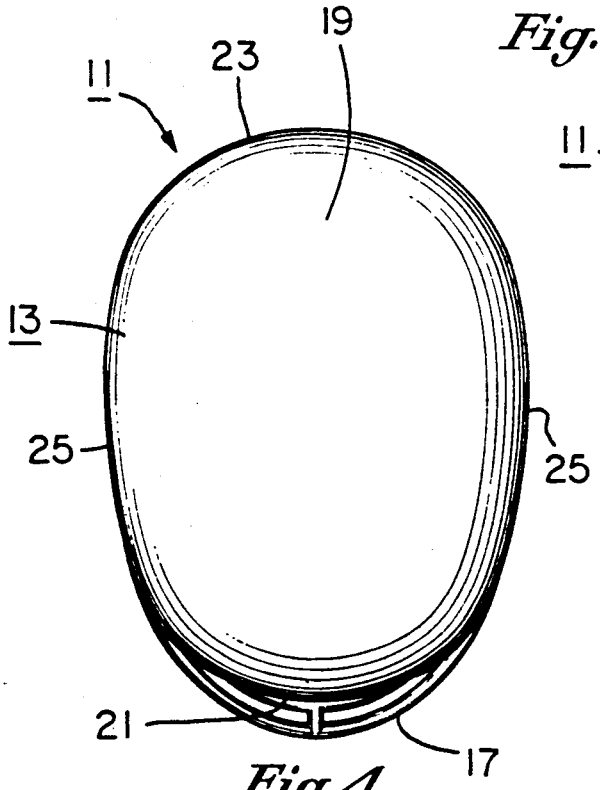
FIG. 4 is a top view of the helmet.
Figure 5:
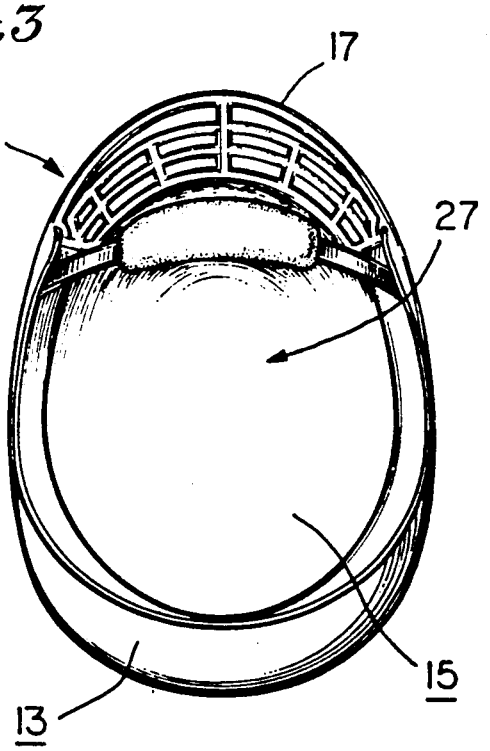
FIG. 5 is a bottom view of the helmet.

The outer shell 13 has integral top, front, rear and side walls 19, 21, 23, 25, with a cavity 27 located therebetween. The cavity 27 is adapted for receiving the head of a human being. As shown in FIG. 4, the helmet 11 is elongated between the front and rear walls 21, 23 relative to the distance between the two side walls 25. As shown in FIG. 2, the helmet is also elongated in the top to bottom direction. The rear wall 23 is wider than the front wall 21 producing a generally oval shape as shown in FIG. 4. The side walls 25 have a slight inward taper from the middle portion of the side walls to the bottom edge of the side walls as shown in FIG. 2. The top wall 19 is rounded, merging smoothly with the front, rear and two side walls 21, 23, 25. The front wall 21 is short, having a lower edge 29 that is located above the eyes of a wearer when the helmet is being worn.

Figure 1:
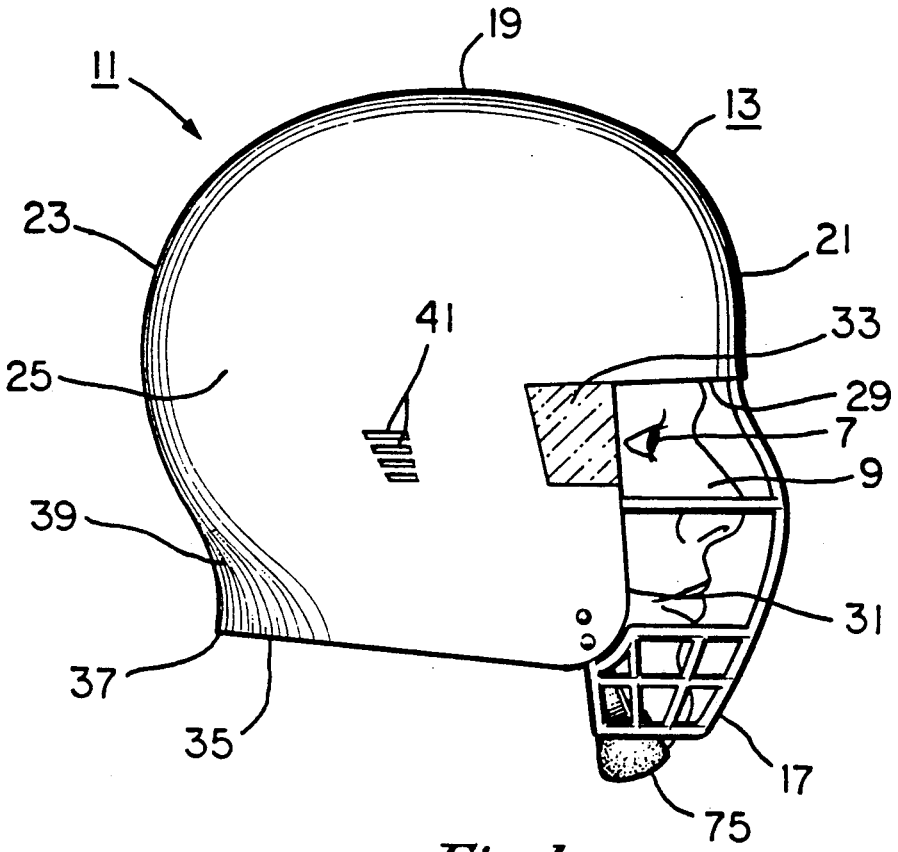
FIG. 1 is a side elevational view of the helmet of the present invention, in accordance with a preferred embodiment showing the face of a human wearer located therein.

The side walls 25 each have a front edge 31 that is located about evenly with the eyes 7 of a wearer 9, as shown in FIG. 1. The side walls 25 have respective transparent windows 33 for allowing peripheral viewing by the wearer. The windows 33 are located at eye level and extend from the front edge 31 of the respective side walls 25 back toward the rear wall 23 for a short distance. The windows 33 are integral with the outer shell 13 so as to provide protection to the side of the head of the wearer. With the helmet on, the wearer can effectively look through the outer shell by way of the windows 33.

The bottom edge 35 of each side wall tapers upwardly from the front edge 31 to the rear wall 23, as shown in FIG. 1. The rear wall 23 has a bottom edge 37 that merges with the bottom edges 35 of the side walls 25. The lower portion 39 of the rear wall 23 curves inwardly with a slight outward flair at the bottom edge 37. This concavity of the lower portion 39 of the rear wall conforms the helmet to the small of the wearer's neck.

Each side wall 25 has plural horizontally oriented ear slots 41. The ear slots 41 are located outward of the wearer's ear and allow the wearer to hear through the outer shell 13. The slots 41 are narrow so as to attenuate sound passing therethrough.

The outer shell 13 is made out of a light-weight material such as nylon and graphite. The material should preferably be amenable to molding so that the outer shell can be molded for economy in manufacturing costs. The outer shell may be injection molded. The windows 33 may be made of a transparent plastic material such as polycarbonate (LEXAN). The outer shell can be molded with notches formed therein for receiving the windows. The windows can then be mounted by a suitable adhesive. The windows may be thicker than the outer shell to provide suitable protection, wherein the windows will protrude slightly from the outer shell. The combination of nylon and graphite makes a tough, durable shell which is light in weight. A light-weight helmet reduces the risk of injury to the neck and head, compared to a heavier helmet.

Figure 6:
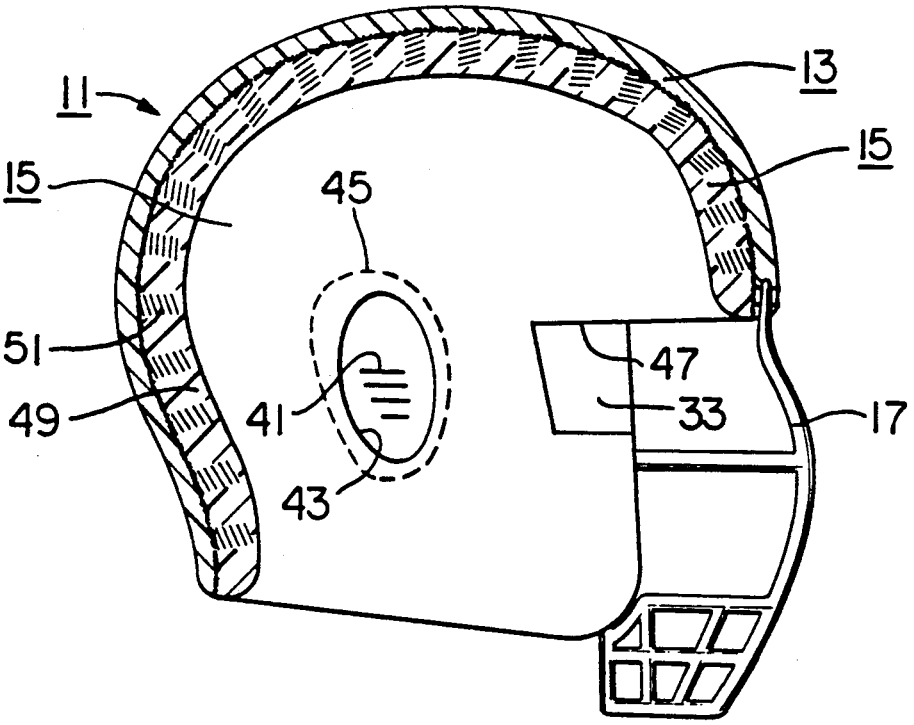
FIG. 6 is a longitudinal cross-sectional view of the helmet.

Referring to FIG. 6, the inner shell 15 is located inside of the outer shell 13 such that the inner shell is interposed between the outer shell and the head of the wearer when the helmet is being worn. Thus, the outer surface of the inner shell 15 is shaped so as to conform to the shape of the inner surface of the outer shell 13. When installed within the outer shell, the inner shell extends to all of the edges of the outer shell. The inner shell 15 has two lateral openings 43 located therein, which openings are positioned so as to surround each group of ear slots 41. The openings 43 are sized smaller than the outer ears 45 of the wearer, wherein the inner shell 15 contacts about 20–40% of each outer ear. The remaining 60–80% of the outer ear, including the ear canal, is exposed to the respective opening 43 and to the respective ear slots 41. The inner shell 15 completely surrounds the ear canal, thus providing a seal that extends 360 degrees around the ear. This sealing effect of the inner shell serves to attenuate any sound not entering the ear via the ear slots 41. The inner shell 15 also has notches 47 formed in the front edge for alignment with the two viewing windows 33, wherein the inner shell does not interfere with viewing through the windows.

Figure 7:
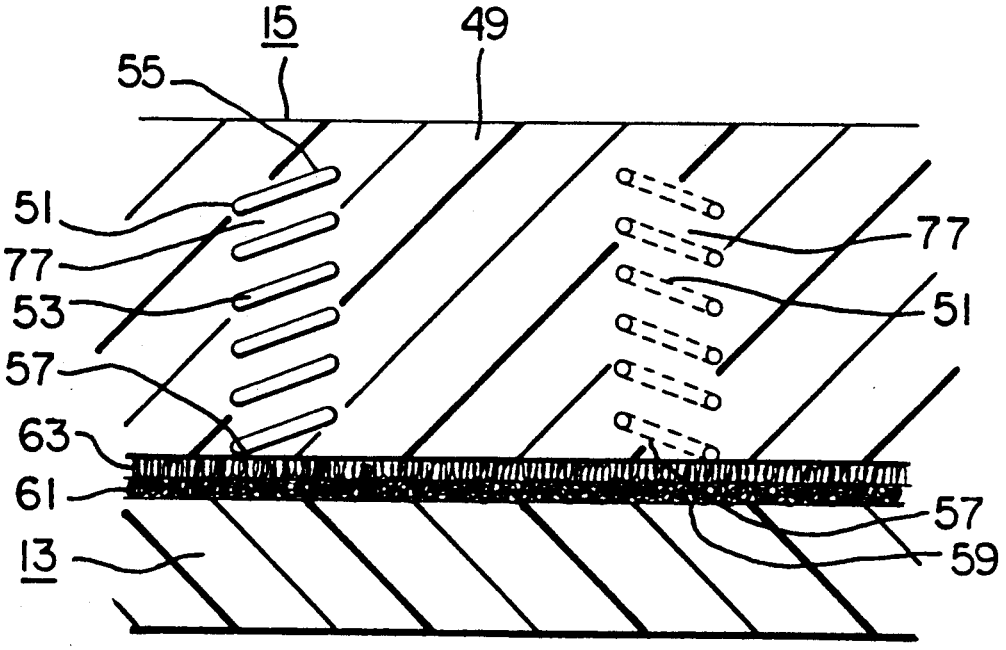
FIG. 7 is a detailed cross-sectional view of the foam inner shell, showing the springs and foam.

The inner shell 15 is made out of a layer of foam 49 with numerous springs 51 embedded therein. The foam layer 49 is made of a flexible and resilient material such as polyurethane or styrofoam. Each spring 51 is a helical type of spring, having a spring winding 53 (see FIG. 7). The windings 53 are coated in plastic for increased safety to the wearer. Each spring 51 has inner and outer ends 55, 57 and is oriented such that the inner end 55 is adjacent to the inner surface of the inner shell and the outer end 57 is adjacent to the outer surface of the inner shell. The outer end 57 of each spring is flush with the outer surface of the inner shell, while the inner end 55 of each spring is located outwardly of the inner surface of the inner shell such that foam 49 is interposed between the inner end of each spring and the head of the wearer. The outer ends 57 of the springs bear on the inner surface of the outer shell, either directly or by way of fasteners. Foam 49 is also located between the windings 53 of each spring. The springs 51 are evenly distributed over the area of the inner shell.

The outer surface of the inner shell 15 couples to the inner surface of the outer shell 13. The inner shell may be interchanged with respect to the outer shell by using a releasable fastener 59 to couple the two shells together. For example, hook and loop fasteners (VELCRO) can be used, with strips of the hook portion 61 fixed to the inner surface of the outer shell 13 and strips of the loop portion 63 fixed to the outer surface of the inner shell 15.

The inner shell 15 may be molded, with the springs 51 being molded into the foam. In the preferred embodiment, the springs 51 are about ½ inch long and are spaced about one inch apart. There is about ¼ inch of foam 49 between the inner ends of the springs and the inner surface of the inner shell.

Figure 8:
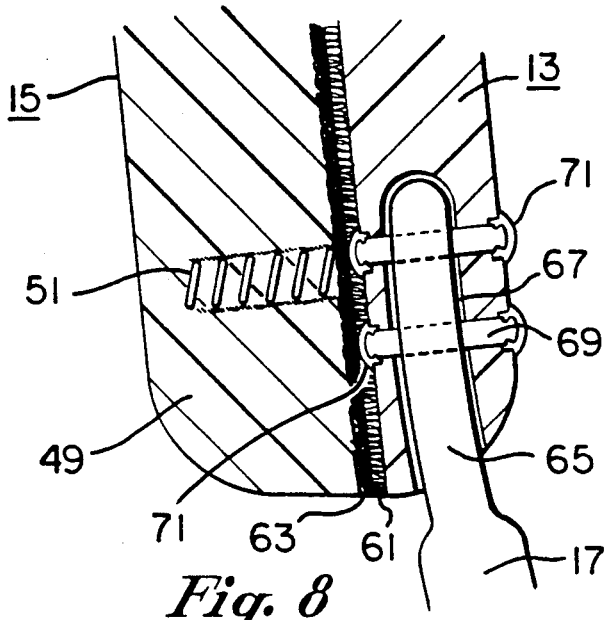
FIG. 8 is a detailed cross-sectional view of the attachment arrangement for attaching the face mask to the helmet outer shell.
Figure 9:
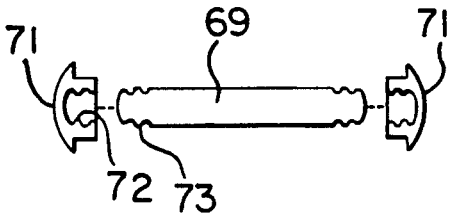
FIG. 9 is an exploded view of a fastener used to fasten the face mask to the helmet outer shell.

The face mask 17 is conventional, except for the manner in which it is coupled to the outer shell 13. As shown in FIG. 2, the face mask couples to the outer shell at plural locations. At each location, the face mask forms a rod, the end of which is flattened 65 (see FIG. 8). The flattened rod ends 65 are inserted into the slots 67 in the edges of the outer shell 13. Pins 69 are used to secure the flattened ends 65 within the slots 67. As shown in FIG. 9, each pin 69 has retaining caps 71 that fit onto the ends of the pin. The ends of the pin 69 and the retaining cap 71 have interlocking projections and grooves 72, 73 for a locking fit. With the flattened rod ends 65 of the face mask inserted into the respective slots 67 of the outer shell 13, the pins 69 are inserted through small circular openings in both the outer shell and the flattened ends. The openings are transverse to the flattened ends 65. The pins 69 are then secured in place with the retaining caps 71. When the face mask 17 is installed, each pin 69 has a retaining cap 71 on the outer surface and a cap 71 on the inner surface of the outer shell 13. The inner retaining cap is covered by the inner shell. The length of the pins are about equal to the thickness of the shell at the slot locations. There are provided two pins 69 per flattened end 65.

A conventional chin strap 75 is provided for securing the helmet snugly onto the head of a wearer. The chin strap is coupled to the side walls 25 of the outer shell by threading the strap ends through slots (not shown).

With the helmet of the present invention, the peripheral vision of the wearer is increased over prior art helmets because of the provision of the two side windows 33. Unlike conventional helmets, which have opaque side walls that prevent peripheral viewing, the windows 33 in the helmet of the present invention allow a wearer to see laterally of his head and even rearwardly of to a certain extent. The side windows 33 extend from the front edge of each side wall rearwardly for a short distance to provide a peripheral viewing path. The windows are positioned laterally of and slightly rearwardly of each eye 7. With the windows, which are integrated into the outer shell, protection of the side of the head of the wearer is maintained while peripheral vision is enhanced.

Another aspect of the helmet of the present invention is the inner shell 15 construction, which is made of numerous springs 51 embedded in foam 49. The foam 49, which is flexible and resilient, has the ability to absorb shock by compressing. The shock absorbability is enhanced by use of the springs 51, which are stiffer than the foam material 49. The outer ends 57 of the springs 51 bear on the outer shell, while the inner ends 55 of the springs are spaced from the head of the wearer by foam. The spring windings of each spring are separated by gaps 77, which gaps are filled with foam material. Thus, the shock absorbability of the inner shell, and the helmet as a whole, is enhanced, thereby increasing the protection available to the wearer.

Figure 10:
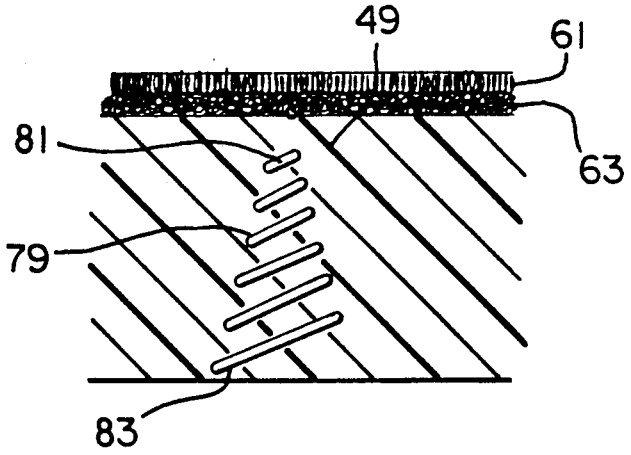
FIG. 10 is a detailed cross-sectional view of the inner shell, in accordance with another embodiment.

Although the helmet has been described as using cylindrical springs in the inner shell, conical helical type springs 79 could also be used (see FIG. 10). The use of conical springs would allow greater compression of the springs over cylindrical springs. This is because with a cylindrical spring 51, the spring may "bottom out", wherein the compression of the spring windings is limited by the windings themselves. The gaps between the windings close so that the windings are limited in movement by the adjacent windings. With conical springs 79 however, the windings are offset from the adjacent windings, thereby allowing the spring to compress to a near flat configuration. The conical springs would be oriented with the small diameter end 81 adjacent to the outer shell and the larger diameter end 83 adjacent to the head of the wearer. Foam 49 is located between the spring windings and a layer of foam separates the larger diameter end 83 from the head of the wearer.

Another aspect of the helmet of the present invention is that the helmet provides hearing protection to the wearer. Some form of hearing protection is desirable because frequently during games, the noise levels are very high. The helmet of the present invention provides hearing protection by the use of narrow slots 41 in the outer shell 13 and by completely surrounding the ear with the foam inner shell 15. The inner shell effectively blocks or attenuates sound not arriving through the slots 41.

Another aspect of the helmet of the present invention is its versatility. Both the inner shell 15 and the face mask 17 can be interchanged to customize the helmet to the particular wearer. The inner shell, with the hook and loop fasteners, is easily removable from the inside of the outer shell. A substitute inner shell may be installed in its place.

The foregoing disclosure and the showings made in the drawings are merely illustrative of the principles of the invention and are not to be interpreted in a limiting sense.

I claim:

1. A helmet for use in sporting activities by a human, comprising:

a) an outer shell having top, back and side walls, said outer shell having an opening therein which opening is adapted to fit the head of a human such that the top wall is on top of the head, the side walls cover the ears and are adjacent to the sides of the face and the back wall covers the back of the head, said outer shell side walls having respective bottom edges, each of said bottom edges merging with a front edge of said respective side wall, each of said front edges extending from said respective bottom edge to said top wall, said outer shell being made of a hard and rigid material, said outer shell being opaque;

b) an inner shell being located inside of said outer shell and being coupled thereto such that said inner shell is interposed between said outer shell and the head of a human when said helmet is being worn, said inner shell extending along said top, back and side walls, said inner shell being made of a material that is flexible and resilient;

c) each of said side walls having a transparent window located therein, said windows extending from the front edge of each side wall rearwardly toward said back wall, wherein the peripheral vision of a human wearing said helmet is enhanced by said windows, said outer shell having respective opaque portions, each of which opaque portions extends between each window and the bottom edge of said outer shell;

d) said inner shell having notches therein, said notches being aligned with said windows, wherein said inner shell does not interfere with viewing through said windows, said inner shell being located adjacent to portions of the ears of said human wearing said helmet so as to provide protection to said ears.

2. The helmet of claim 1 wherein said inner shell is made out of flexible and resilient foam and has numerous spring means installed therein, said spring means being less resilient than said foam, each of said spring means having two ends with one end being located adjacent to said outer shell and the outer end being located adjacent to the head of a human when said helmet is being worn, there being foam interposed between said spring means and the head of said human, said spring means being distributed over areas corresponding to the top, back and side walls wherein said spring means serve to absorb the shock produced by an impact to said outer shell.

3. The helmet of claim 2 wherein said spring means comprises helical springs and have spring windings, said helical springs being located in said foam inner shell such that said foam is interposed between said spring windings.

4. The helmet of claim 3 wherein said springs windings are plastic coated.

5. The helmet of claim 1, wherein said inner shell is removable from said outer shell, said inner shell being coupled to an inner surface of said outer shell with hook and loop fasteners.

6. The helmet of claim 1 wherein said outer shell is made out of a light-weight material that can be moldable.

7. The helmet of claim 1 wherein each of said outer shell side walls have narrow slots, said slots being located adjacent to the ears of a wearer when wearing said helmet, and said inner shell has two openings therein, said openings being located so as to correspond to said slots, said openings being closed such that each opening has 360 degrees of foam surrounding each opening, wherein said inner shell and said slots provide some hearing protection to a wearer.

8. The helmet of claim 1, wherein:

a) said inner shell is made out of flexible and resilient foam and has numerous spring means installed therein, said spring means being less resilient than said foam, each of said spring means having two ends with one end being located adjacent to said outer shell and the other end being located adjacent to the head of a human when said helmet is being worn, there being foam interposed between said spring means and the head of said human, said spring means being distributed over areas corresponding to the top, back and side walls wherein said spring means serve to absorb the shock produced by an impact to said outer shell;

b) each of said outer shell side walls have narrow slots, said slots being located adjacent to the ears of a wearer when wearing said helmet, and said inner shell has two openings therein, said openings being located so as to correspond to said slots, said openings being closed such that each opening has 360 degrees of foam surrounding each opening, wherein said inner shell and said slots provide some hearing protection to a wearer.

9. The helmet of claim 8, wherein:

a) said spring means comprises helical springs located in said foam inner shell such that said foam is interposed between said spring windings;

b) said inner shell is removable from said outer shell, said inner shell being coupled to an inner surface of said outer shell with hook and loop fasteners.

10. The helmet of claim 1 wherein said respective windows are integral with said respective side walls.

11. A helmet for use in sporting activities by a human, comprising:

a) an outer shell having top, back and side walls, said outer shell having an opening therein which opening is adapted to fit the head of a human such that the top wall is on top of the head, the side walls cover the ears and are adjacent to the sides of the face and the back wall covers the back of the head, said outer shell side walls having respective bottom edges, each of said bottom edges merging with a front edge of said respective side wall, each of said front edges extending from said respective bottom edge to said top wall, said front edges being located laterally of the eyes of a human when said helmet is being worn, said outer shell being made of a hard and rigid material, said outer shell being opaque;

b) said side walls each having a transparent window located therein, said windows extending from said front edges of each side wall rearwardly towards said back wall, said windows being located so that the peripheral vision of a wearer is enhanced by said windows, said outer shell having respective opaque portions, each of which extends between each window and the bottom edge of said outer shell;

c) an inner shell located inside of said outer shell and coupled thereto such that said inner shell is interposed between said outer shell and the head of a human when said helmet is being worn, said inner shell extending along said top, back and side walls, said inner shell being made of a material that is flexible and resilient, said inner shell having notches formed therein, said notches corresponding to said windows so as to permit viewing through said windows;

d) a face mask coupled to said outer shell, said face mask being coupled to said outer shell at said opaque portions extending between said windows and the bottom edges of said outer shell.

12. The helmet of claim 10 wherein said inner shell is made out of flexible and resilient foam and has numerous spring means installed therein, said spring means being less resilient than said foam, each of said spring means having two ends with one end being located adjacent to said outer shell and the other end being located adjacent to the head of a human when said helmet is being worn, there being foam interposed between said spring means and the head of said human, said spring means being distributed over areas corresponding to the top, back and side walls wherein said spring means serve to absorb the shock produced by an impact to said outer shell.

13. The helmet of claim 12 wherein said spring means comprises helical springs and have spring windings, said helical springs being located in said foam inner shell such that said foam is interposed between said spring windings.

14. The helmet of claim 13 wherein said springs windings are plastic coated.

15. The helmet of claim 11, wherein said inner shell is removable from said outer shell, said inner shell being coupled to an inner surface of said outer shell with hook and loop fasteners.

16. The helmet of claim 11 wherein said outer shell is made out of a light-weight material that can be moldable.

17. The helmet of claim 11 wherein each of said outer shell side walls have narrow slots, said slots being located adjacent to the ears of a wearer when wearing said helmet, and said inner shell has two openings therein, said openings being located so as to correspond to said slots, said openings being closed such that each opening has 360 degrees of foam surrounding each opening, wherein said inner shell and said slots provide some hearing protection to a wearer.

18. The helmet of claim 11, wherein:

a) said inner shell is made out of flexible and resilient foam and has numerous spring means installed therein, said spring means being less resilient than said foam, each of said spring means having two ends with one end being located adjacent to said outer shell and the other end being located adjacent to the head of a human when said helmet is being worn, there being foam interposed between said spring means and the head of said human, said spring means being distributed over areas corresponding to the top, back and side walls wherein said spring means serve to absorb the shock produced by an impact to said outer shell;

b) each of said outer shell side walls have narrow slots, said slots being located adjacent to the ears of a wearer when wearing said helmet, and said inner shell has two openings therein, said openings being located so as to correspond to said slots, said openings being closed such that each opening has 360 degrees of foam surrounding each opening, wherein said inner shell and said slots provide some hearing protection to a wearer.

19. The helmet of claim 10, wherein said inner shell has notches therein, said notches being aligned with said windows, wherein said inner shell does not interfere with viewing through said windows, said inner shell being located adjacent to portions of the ears of said human wearing said helmet so as to provide protecting to said ears.

20. A helmet for use in sporting activities by a human, comprising:

a) an outer shell having top, back and side walls, said outer shell having an opening therein which opening is adapted to fit the head of a human such that the top wall is on top of the head, the side walls cover the ears and are adjacent to the sides of the face and the back wall covers the back of the head, said outer shell being made of a hard and rigid material;

b) said outer shell side walls having respective front edges that are located laterally of the eyes of a wearer, said side walls each having a transparent window located therein, said windows extending from said front edges of each side wall rearwardly towards said back wall, said windows being located so that the peripheral vision of a wearer is enhanced by said windows;

c) an inner shell located inside of said outer shell and coupled thereto such that said inner shell is interposed between said outer shell and the head of a human when said helmet is being worn, said inner shell extending along said top, back and side walls, said inner shell being made of a material that is flexible and resilient, said inner shell having notches formed therein, said notches corresponding to said windows so as to permit viewing through said windows;

d) a face mask coupled to said outer shell;

e) said face mask has ends that are received by said outer shell, each of said face mask ends being coupled to said outer shell by pins that are transverse to said respective face mask ends, said pins being received by openings in said outer shell and in said face mask ends, said pins being retained in said outer shell by releasable retaining means.

21. The helmet of claim 20, wherein:

a) said inner shell is made out of flexible and resilient foam and has numerous spring means installed therein, said spring means being less resilient than said foam, each of said spring means having two ends with one end being located adjacent to said outer shell and the other end being located adjacent to the head of a human when said helmet is being worn, there being foam interposed between said spring means and the head of said human, said spring means being distributed over areas corresponding to the top, back and side walls wherein said spring means serve to absorb the shock produced by an impact to said outer shell;

b) said spring means comprises helical springs and have spring windings, said helical springs being located in said foam inner shell such that said foam is interposed between said spring windings;

c) each of said outer shell side walls have narrow slots, said slots being located adjacent to the ears of a wearer when wearing said helmet, and said inner shell has two openings therein, said openings being located so as to correspond to said slots, said openings being closed such that each opening has 360 degrees of foam surrounding each opening, wherein said inner shell and said slots provide some hearing protection to a wearer;

d) said inner shell is removable from said outer shell, said inner shell being coupled to an inner surface of said outer shell with hook and loop fasteners.

22. A helmet for use in sporting activities by a human, comprising:

a) an outer shell having top, back and side walls, said outer shell having an opening therein which opening is adapted to fit the head of human such that the top wall is on top of the head, the side walls cover the ears and are adjacent to the sides of the face and the back wall covers the back of the head, said side walls each having a front edge extending to said top wall, said front edges and said top wall forming a front opening through which a human wearing said helmet can see, said front edges being located evenly with the eyes of said human;

b) said outer shell being made of a hard and rigid material, said outer shell being opaque;

c) each of aid side walls having a transparent window located therein, said windows being integral with said respective side walls, said windows extending from the front edge of each side wall rearwardly toward said back wall, wherein the peripheral vision of a human wearing said helmet is enhanced by said windows, said outer shell having respective opaque portions, each of which extends between each window and the bottom edge of said outer shell;

d) a face mask coupled to said outer shell, said face mask extending across said front opening, said face mask being coupled to said outer shell at said opaque portions extending between said windows and the bottom edges of said outer shell.

* * * * *